US006561631B2

(12) United States Patent
Shin et al.

(10) Patent No.: US 6,561,631 B2
(45) Date of Patent: May 13, 2003

(54) INK JET PRINTER HEAD

(75) Inventors: Kyu-ho Shin, Suwon (KR); Su-ho Shin, Suwon (KR); Seong-taek Lim, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/867,764

(22) Filed: May 31, 2001

(65) Prior Publication Data

US 2002/0039127 A1 Apr. 4, 2002

(30) Foreign Application Priority Data

Sep. 30, 2000 (KR) ..... 2000-57690

(51) Int. Cl.[7] ..... B41J 2/05; B41J 2/17
(52) U.S. Cl. ..... 347/65; 347/44
(58) Field of Search ..... 347/47, 63, 65, 347/67, 94, 44, 45, 20, 54, 56

(56) References Cited

U.S. PATENT DOCUMENTS 4,897,674 A * 1/1990 Hirasawa ..... 347/94
5,463,413 A * 10/1995 Ho et al. ..... 347/65
5,883,650 A 3/1999 Figueredo et al. ..... 347/62
5,900,894 A 5/1999 Koizumi et al. ..... 347/65
6,283,584 B1 * 9/2001 Powers et al. ..... 347/65

FOREIGN PATENT DOCUMENTS

EP 0564069 A2 10/1993 ..... B41J/2/16
JP 04161340 * 6/1992 ..... B41J/2/05

OTHER PUBLICATIONS

English abstract of JP 04161340 published Jun. 4, 1992.

* cited by examiner

*Primary Examiner*—Craig Hallacher
*Assistant Examiner*—Juanita Stephens
(74) *Attorney, Agent, or Firm*—Staas & Halsey LLP

(57) ABSTRACT

An ink jet printer head includes a substrate having a heat resisting body, an ink chamber barrier installed on the substrate so as to form a side wall of an ink chamber filled with ink introduced through an ink channel, and a nozzle plate having a nozzle hole communicating with the ink chamber and installed on the ink chamber barrier, and an ink separating wall protruding from a periphery of the nozzle hole towards the substrate located on the ink channel to interrupt a flow of the ink is provided in the nozzle plate. The backflow of the ink into the interior of the ink channel and an ink tail generated in the nozzle and a satellite droplet are reduced by using the ink separating wall, thereby improving printing efficiency and printing quality.

15 Claims, 11 Drawing Sheets

INK JET PRINTER HEAD

CROSS-REFERENCE TO RELATED APPLICATIONS

This application claims the benefit of Korean Application No. 2000-57690, filed Sep. 30, 2000, in the Korean Patent Office, the disclosure of which is incorporated herein by reference.

BACKGROUND OF THE INVENTION

1. Field of the Invention

The present invention relates to an ink jet printer head, and more particularly, to an ink jet printer head capable of increasing printing efficiency and quality by improving a structure of an ink passage, to decreas ink back flow backflow and improve an ink droplet shape.

2. Description of the Related Art

Generally, an ink jet printer head uses a thermal driving method or a piezoelectric driving method to discharge ink. According to the thermal driving method, ink is instantly heated by a heat resisting body, generating a bubble. As the bubble is inflated, ink is discharged to a nozzle hole by the pressure of the bubble. According to the piezoelectric driving method, ink is discharged to a nozzle hole by the force applied from the displacement of a piezoelectric body.

Conventional thermal driving ink jet printer heads are grouped into two types based upon a discharge direction with respect to a substrate and a nozzle plate: (1) a side shooting type (as shown in FIG. 1A) and (2) an upper surface shooting type (as shown in FIG. 1B).

According to the side shooting type ink jet printer head 10 of FIG. 1A, a nozzle hole 16 is formed at one side end portion of an ink channel 13, which is formed between a substrate 11 and a nozzle plate 12. A bubble 2 is generated from ink 1 of the ink channel 13, which is instantly heated by a thin film heat resisting body 14. Due to the growing pressure exerted by the bubble 2, the ink 1 is discharged from the nozzle hole 16 to the outside.

The upper surface shooting type ink jet printer head 20 of FIG. 1B comprises an ink chamber barrier 23, which is formed on a substrate 11 (not shown) on which a thin film radiating resistance body (not shown) is disposed to form an ink chamber 24 communicating with an ink channel 22, and a nozzle plate 25, which is formed on the ink chamber barrier 23 and has a nozzle hole 26 communicating with the ink chamber 24.

According to the ink jet printer head 20, the ink (not shown) of the ink chamber 24 is instantly heated by heating a thin film heat resisting body (not shown). A bubble (not shown) is generated from the heated ink and expands, creating pressure against an interior of the ink chamber 24, and discharging the ink to the outside through the nozzle hole 26.

However, in the conventional ink jet printer heads 10 and 20, an ink backflow phenomenon occurs due to an inflating pressure of the bubble 2, in which the ink 1 reverses into the ink channels 13 and 22. The ink backflow accompanies a cross-talk in the printing operation, and deteriorates the printing quality.

Furthermore, in the conventional ink jet printer heads 10 and 20, a tail is generated in a discharging ink drop when the bubble 2 decreases in size. The ink drop tail is extended by the surface tension and the viscosity of the ink 1. The ink drop tail generates several fragments, and accordingly decreases the resolution and print quality.

In order to overcome the above-mentioned problems, in the conventional side shooting type ink jet printer head 10, the length of the ink channel 13 is increased to restrain the generation of the backflow and the ink drop tail. However, such a structure increases the size of the ink jet printer head and decreases the ink discharging efficiency.

In the upper surface shooting type ink jet printer head 20, a neck is formed by machining step portions 23*a* and 23*b* in the ink channel 22 of the ink chamber barrier 23, formed on substrate 21, to restrain the backflow of the ink. However, such a structure requires a complex manufacturing process. Also, because the height of the ink channel 22 formed between the ink chamber 24 and the nozzle plate 25 remains constant, printer efficiency is restricted.

SUMMARY OF THE INVENTION

Accordingly, it is an object of the present invention to solve the above-mentioned problems of the conventional printer heads. It is another object of the present invention to provide an ink jet printer head with increased printing efficiency and printing quality.

It is a further object of the present invention to provide an ink jet printer head with an improved ink passage, reduced backflow, and improved [the shape of the] ink droplet shape.

Additional objects and advantages of the invention will be set forth in part in the description which follows, and, in part, will be obvious from the description, or may be learned by practice of the invention.

The foregoing objects of the present invention are achieved by providing an ink jet printer head including a substrate having a heat resisting body, an ink chamber barrier installed on the substrate to form a side wall of an ink chamber filled with ink introduced through an ink channel, and a nozzle plate having a nozzle hole formed to communicate with the ink chamber and installed on the ink chamber barrier. An ink separating wall protrudes from the periphery of the nozzle hole towards the substrate so as to be located on the ink channel to interrupt the flow of the ink provided in the nozzle plate.

BRIEF DESCRIPTION OF THE DRAWINGS

These and other objects and advantages of the invention will become apparent and more readily appreciated from the following description of the preferred embodiments, taken in conjunction with the accompanying drawings of which.

DESCRIPTION OF THE PREFERRED EMBODIMENTS

Figure 1A:
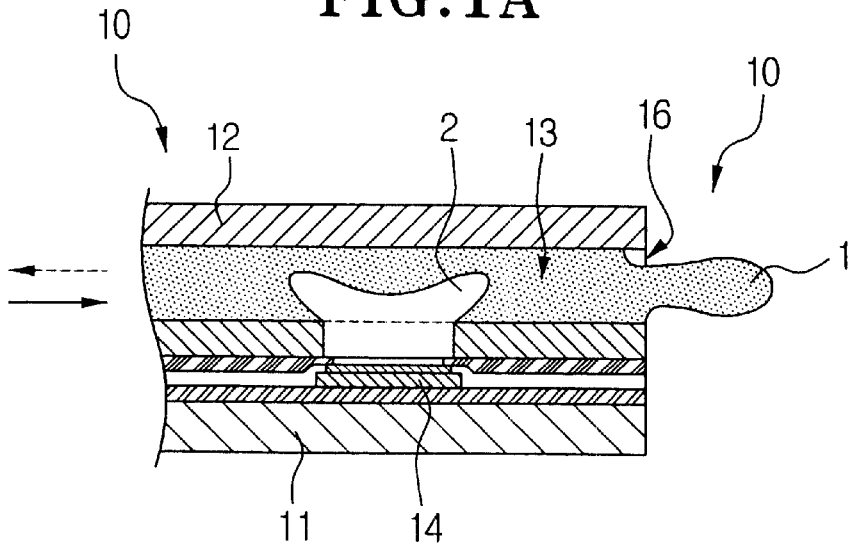
PRIOR ART FIG. 1A
FIG. 1A is a partial cross-sectional view of a conventional side shooting type ink jet printer head.
Figure 1B:
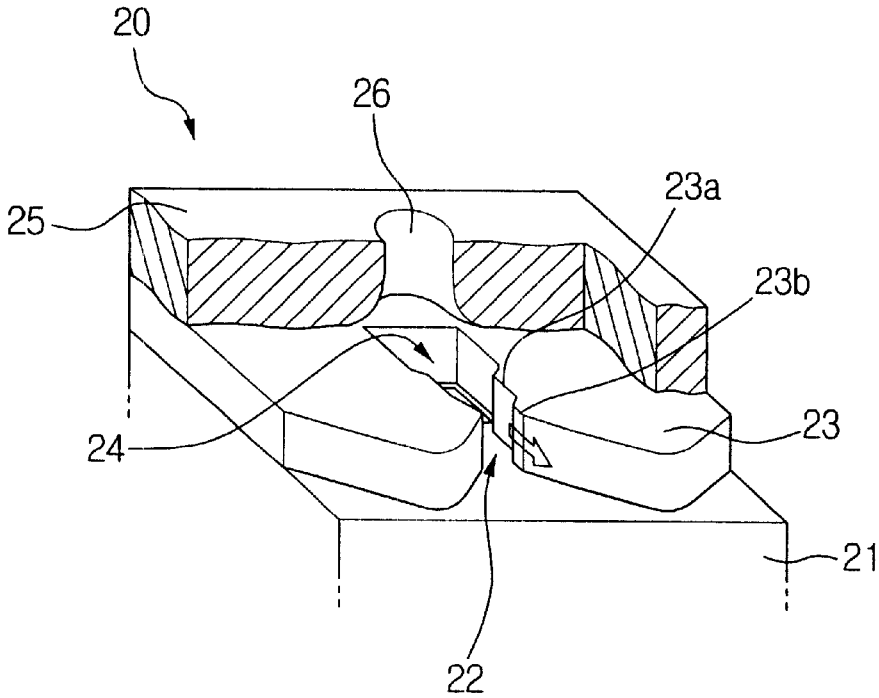
PRIOR ART FIG. 1B
FIG. 1B is a partial cross-sectional view of a conventional upper surface shooting type ink jet printer head.

Reference will now be made in detail to the present preferred embodiments of the present invention, examples of which are illustrated in the accompanying drawings, wherein like reference numerals refer to like elements throughout.

Figure 2:
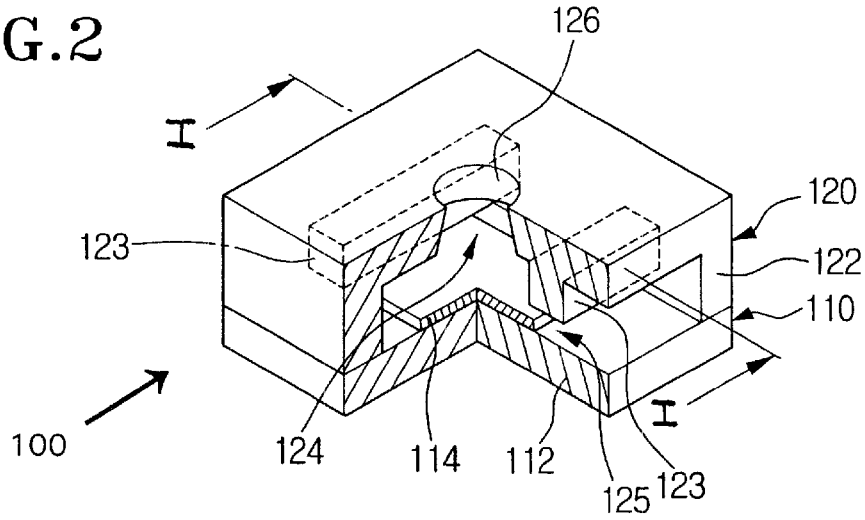
FIG. 2 is a perspective view schematically showing a portion of an ink jet printer head according to a first embodiment of the present invention.
Figure 3:
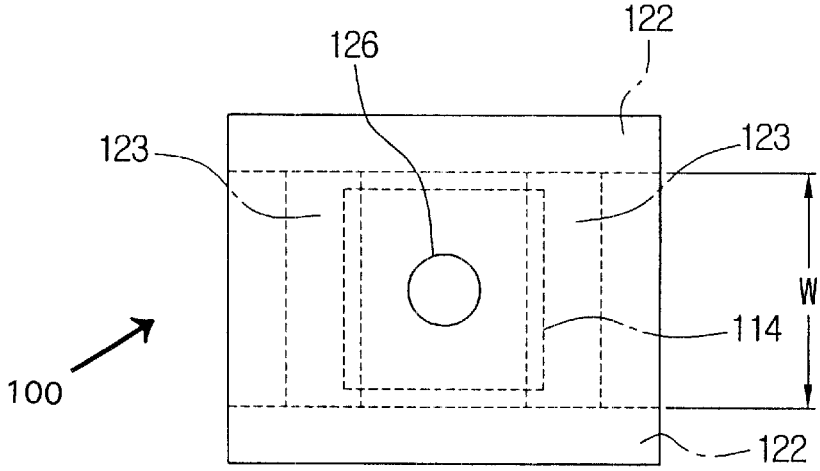
FIG. 3 is a top view of the ink jet printer head of FIG. 2.
Figure 4:
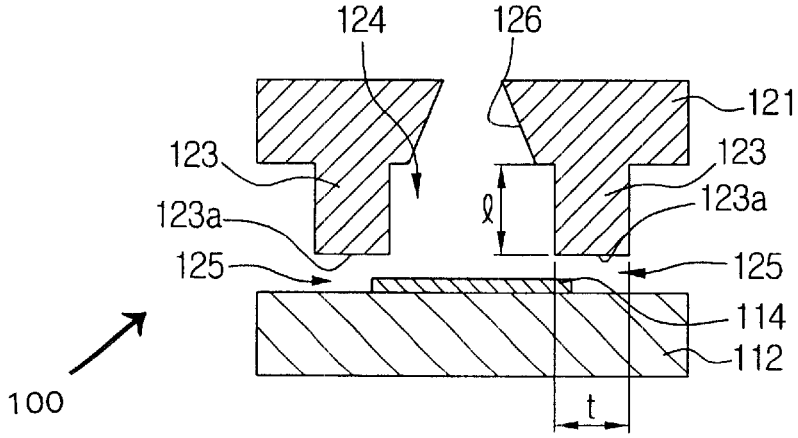
FIG. 4 is a schematic cross-sectional view of the ink jet printer head taken along line I—I of FIG. 2.

FIGS. 2 to 4 show a unit discharging structure of an ink jet printer head according to a first embodiment of the present invention. Although the head of an ink jet printer is formed by aggregating a plurality of unit discharging structures, here, a single unit discharging structure will be referred to as an ink jet printer head for simplicity.

Figure 5:
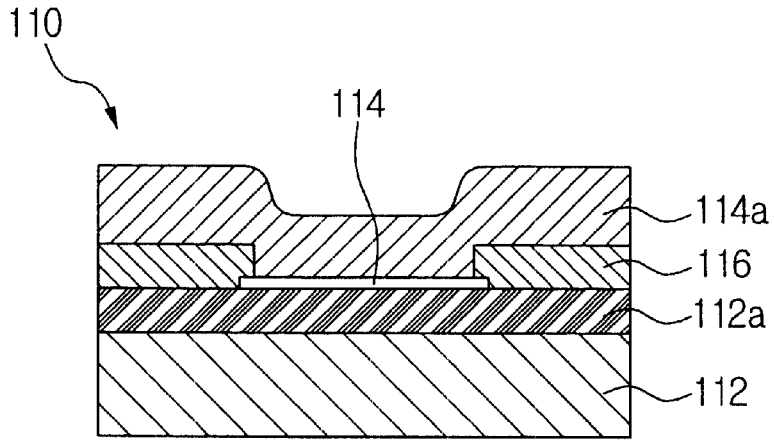
FIG. 5 is a vertical cross-sectional view of the heat radiating driving section of FIG. 2.

The ink jet printer head 100 (i.e., one unit discharging head) comprises a heat radiating section 110 and a nozzle section 120. As shown in FIGS. 2 and 5, the heat radiating section 110 includes an oxide film 112*a* formed on a substrate 112 and a heat resisting body 114 formed at a central portion of the oxide film 112*a*. A wire 116 is formed on the oxide film 112*a* and the heat resisting body 114. The wire 116 is etched, except at the periphery of the heat resisting body 114. A heat protecting layer 114*a* is formed on the wire 116. The oxide film 112*a* acts as an insulating member, and the heat resisting body 114 converts an electrical signal, applied from an outside driving circuit (not shown) through the wire 116, into heat energy. The heat protecting layer 114*a* is formed on the heat resisting body 114 and the upper portion of the wire 116 to prevent damage generated by the impact when a bubble 2 (shown in FIGS. 8A to 8H) formed of ink 1 shrinks. The heat protecting layer 114*a* also acts as an insulating member. The substrate 112 is made of a silicon wafer, and the heat resisting body 114 is made of Ta—Al or polysilicon. The heat protecting layer 114*a* is made of a complex material of a silicon oxide film or a silicon nitride film and a metal layer.

Figure 6:
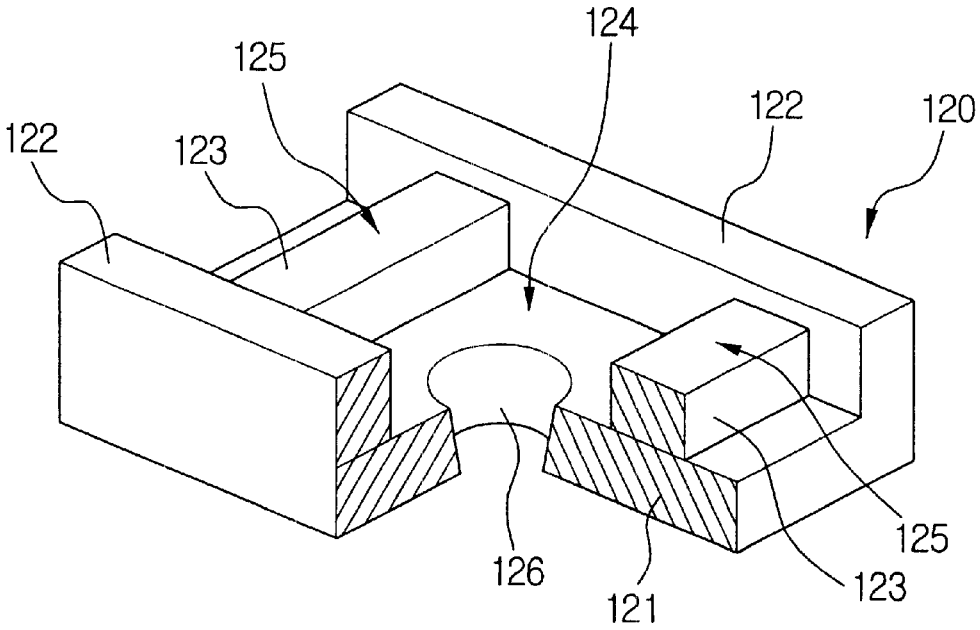
FIG. 6 is a perspective view of the nozzle section of FIG. 2.

As shown in FIGS. 2 and 6, the nozzle section 120 is formed by forming an ink chamber barrier 122, an ink separating wall 123, and a nozzle hole 126 on a nozzle plate 121. The ink separating wall 123 is formed on the nozzle plate 121 to interrupt the ink flow through an ink channel 125. A bonding layer is formed on the upper surface of the ink chamber barrier 122 to bond the ink chamber barrier 122 to the substrate 112.

The ink jet printer head 100 of the present invention is formed by bonding the heat driving section 110 of FIG. 5 to the nozzle section 120 of FIG. 6. The bonding is accomplished by bonding a bonding layer of the upper surface of the ink chamber barrier 122 to the substrate 112 by a thermal compression. The upper and lower surfaces of the ink jet printer head 100 are created by the substrate 112 and the nozzle plate 121, and the front and rear side walls are created by the ink chamber barrier 122. An ink chamber 124 is a space defined in the ink separating wall 123. The ink channel 125 is a passage through which the ink 1 is supplied to the ink chamber 124 from an ink receptacle (not shown).

For simplicity, the oxide film 112*a* of the upper surface of the substrate 112, the wire 116, and the heat protecting layer 114*a* are omitted from FIGS. 2 to 4. As shown in FIGS. 3 and 4, a tip end portion 123*a* of the ink separating wall 123 is separated vertically from the heat resisting body 114. The ink separating wall 123 and a portion of both ends of the heat resisting body 114 are laid horizontally over the substrate 112 so that the ink chamber 124 and the ink channel 125 can be automatically blocked by the bubble 2 generated by the heat resisting body 114. A thickness (t) of the ink separating wall 123 is smaller than a height from the upper surface of the heat resisting body 114 installed on the substrate 112 to the lower surface of the nozzle plate 121. A length (l) of the ink separating wall 123 is smaller than the length of the ink channel 125. A width (w) of the ink separating wall 123 is smaller than the width of the ink chamber 124 and is larger than the width of the heat resisting body 114.

Figure 7A:
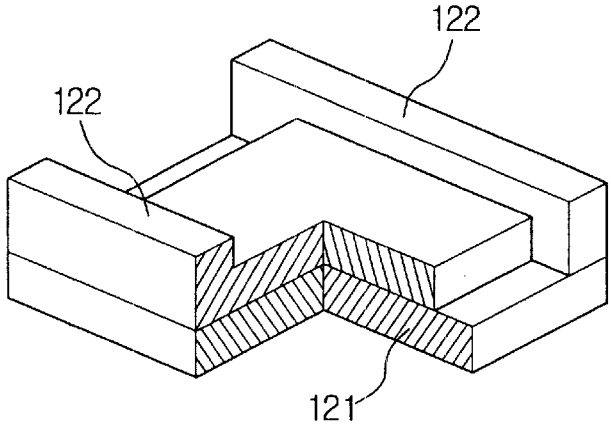
FIGS. 7*a* to 7*c* are perspective views for explaining the manufacturing process of the nozzle section of FIG. 6.
Figure 7B:
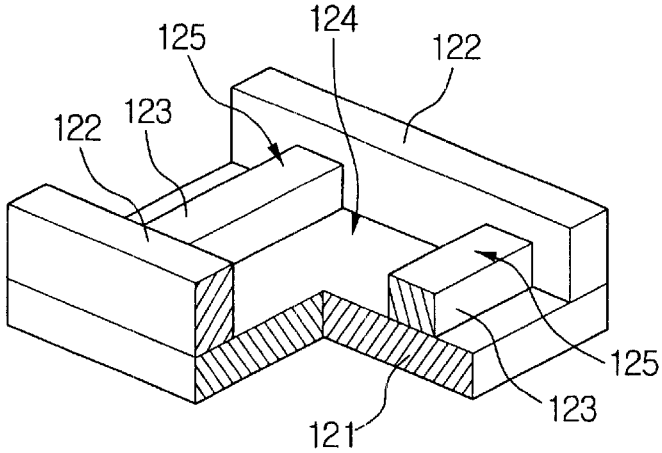
Figure 7C:
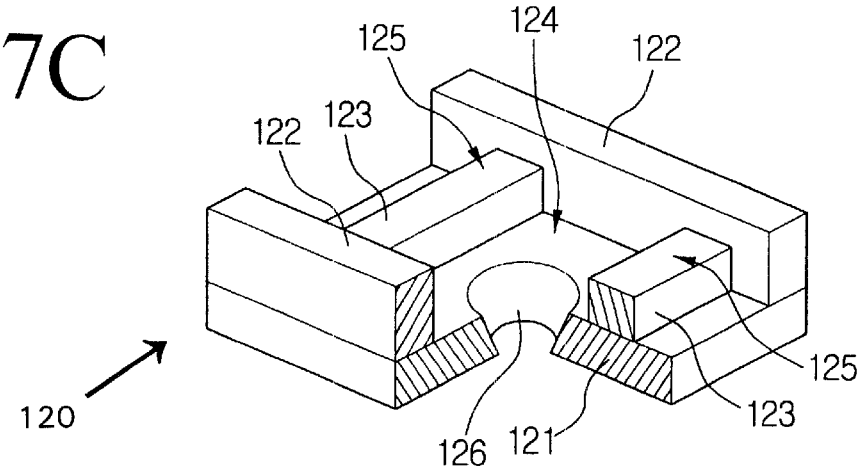

Referring to FIGS. 7A to 7C, a method of forming the nozzle section 120 will be explained. In order to form the nozzle section 120 of the ink jet printer head 100 of the present invention, the nozzle plate 121 is machined by using an excimer laser. The nozzle plate 121, the ink chamber barrier 122, the ink separating wall 123, and the nozzle hole 126 are formed by processing a polymer plate with the excimer laser. First, as shown in FIG. 7A, by using a first mask (not shown) having openings corresponding to an area where the ink chamber barrier 122 is to be formed, a rectangular polymer plate is first machined by the excimer laser to a predetermined depth, shaping an upper side of the ink chamber barrier 122 and an end of the ink separating wall 123, and thus partially forming the ink chamber barrier 122. Second, as shown in FIG. 7B, an ink chamber 124 is defined by machining the polymer plate to a predetermined depth by using a second mask (not shown) and the excimer laser, completely shaping the ink separating wall 123. Accordingly, after the second machining process, the nozzle plate 121, the ink chamber barrier 122, and the ink separating wall 123 are completely shaped. Finally, as shown in FIG. 7C, by using a third mask (not shown) and irradiating the excimer laser to the nozzle plate 121, a nozzle hole 126 is formed in the nozzle plate 121 having a gradually decreasing diameter toward an ink exiting side. Accordingly, the nozzle section 120 is completely formed.

Although not shown, another method of forming the nozzle section 120 is to laminate and pattern a photosensitive polymer. A sacrifice layer of a predetermined thickness is laminated on the substrate 112 by vapor deposition or sputtering. Here, the predetermined thickness of the sacrifice layer corresponds to a length from the nozzle plate 121 to an upper portion of the ink chamber barrier 122. Next, the sacrifice layer is patterned to have a certain width and length, the suitable measurements for the ink separating wall 123, and to define a space between the ink separating wall 123 and the heat resisting body 114. Then a photosensitive polymer film is laminated on the substrate 112 as a material to form the ink chamber 124 on the patterned sacrifice layer, and the photosensitive polymer film is etched. Then, the nozzle section 120 is completed by removing the sacrifice layer from the lower portion of the ink chamber 124 and thus forming the ink separating wall 123. The ink chamber 124 can be formed by spin coating a photoresist.

Figure 8A:
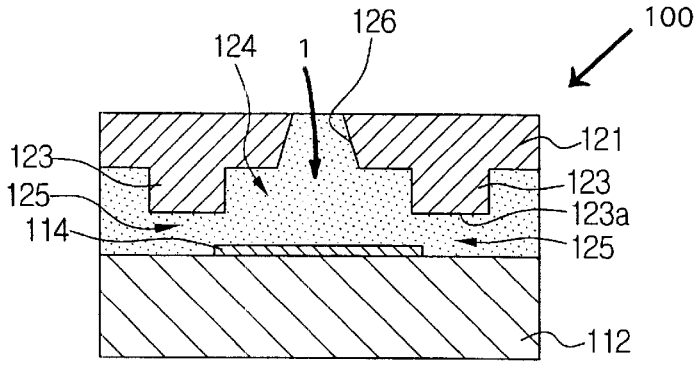
FIGS. 8A to 8H are cross-sectional views for explaining an ink discharging process of the ink jet printer head shown in FIG. 2.
Figure 8B:
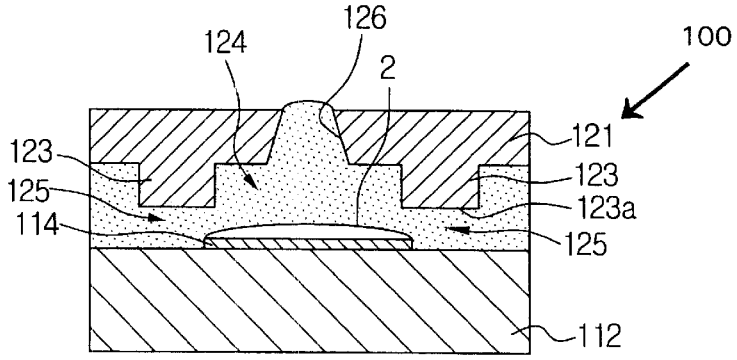

FIGS. 8A to 8H show the processes in which the ink 1 is discharged from the ink jet printer head 100 according to the first embodiment of the present invention. As shown in FIG. 8A, before generation of the bubble 2, the ink 1 is reserved in the ink chamber 124. Then, with an electrical signal applied to the heat resisting body 114, the bubble 2 is generated by the heat energy generated from the heat resisting body 114. Accordingly, as shown in FIG. 8B, the ink 1 is discharged through the nozzle hole 126 by the bubble 2. Since the bubble 2 does not reach the ink separating wall 123, which is separated from the heat resisting body 114, there is an ink flow only between the ink chamber 124 and the ink channel 125.

Figure 8C:
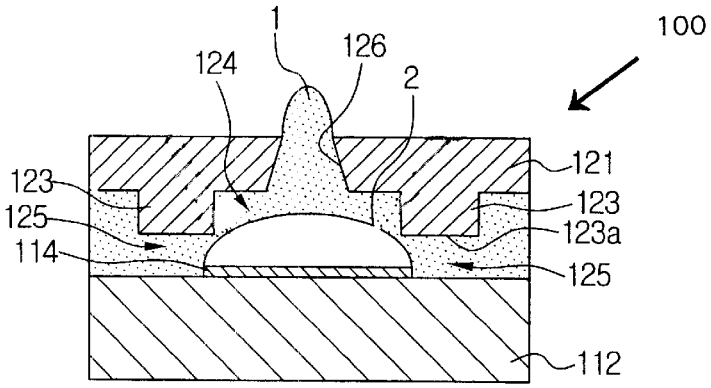
Figure 8D:
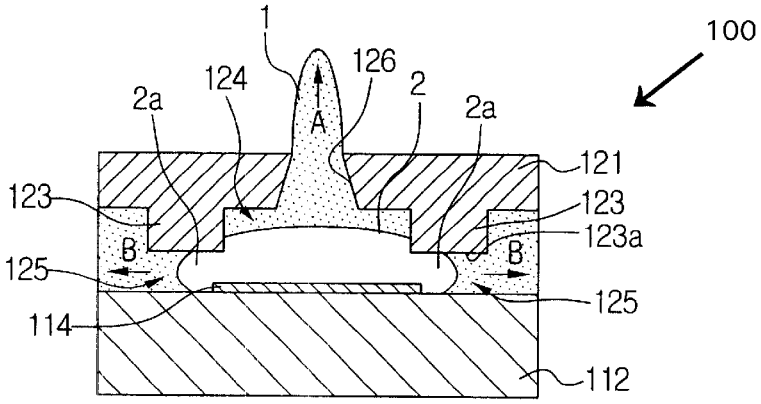
Figure 8E:
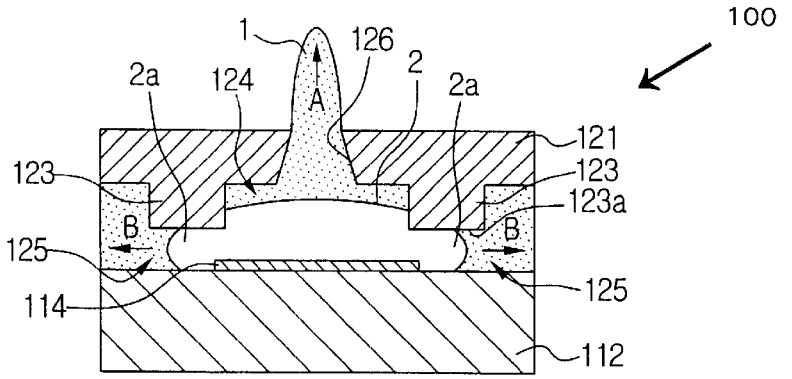

However, as shown in FIG. 8C, if the heating by the heat resisting body 114 continues, the bubble 2 is inflated and the interior pressure is increased, and, as shown in FIG. 8D, the phase varying sections 2*a* reach the ink separating wall 123 and the ink chamber 124. As a result, the ink channel 125 is blocked by the bubble 2. Therefore, as shown in FIGS. 8D and 8E, once the ink chamber 124 and the ink channel 125 are blocked by the bubble 2, these elements remain blocked until the electrical signal to the heat resisting body 114 is cut off and the bubble 2 loses inertia. Since a flowing resistance in the reverse direction (arrow B) is larger than that in the discharging direction (arrow A), an amount of backflow of the ink 1 is reduced, and the inflating force of the bubble 2 can be efficiently used to discharge the ink 1 through the nozzle hole 126.

Figure 8F:
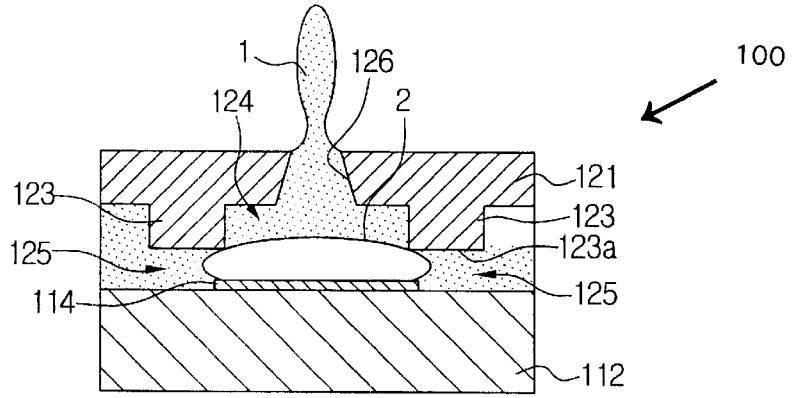
Figure 8G:
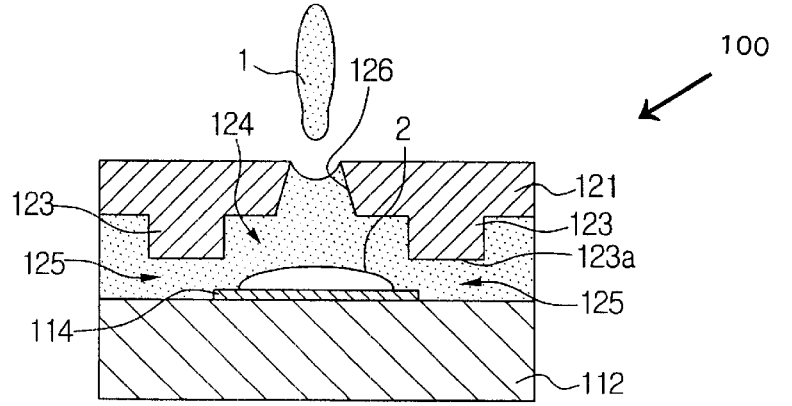
Figure 8H:
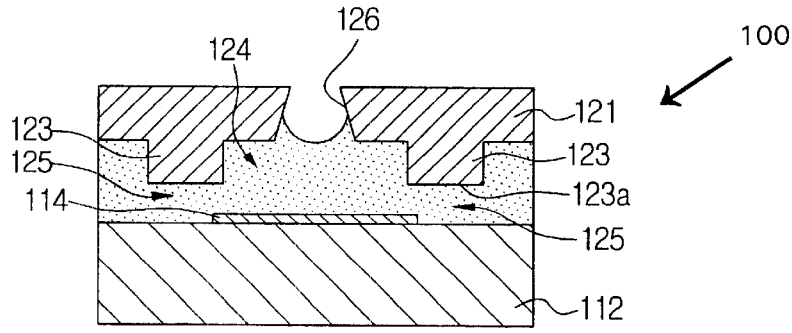

As shown in FIGS. 8F to 8H, while the ink 1 is discharged through the nozzle hole 126, the interior pressure on the bubble 2 decreases, and the bubble 2 loses its inertia and shrinks. The ink 1 is ejected to a printing medium (not shown) from the nozzle hole 126 to accomplish the printing.

As mentioned above, according to the ink jet printer head 100 of the first embodiment of the present invention, since the ink chamber 124 is separated from the ink channel 125 by the bubble 2, only the ink 1 isolated in the ink chamber 124 is ejected. Therefore, generation of the ink tail and the satellite droplet is reduced.

On the other hand, if the flow resistance in the ink channel 125 is too large, the time to recharge the ink 1 in the ink chamber 124 is lengthened, and the printing speed is decreased. In such a case, the flow resistance can be reduced by decreasing the thickness (t) of the ink separating wall 123.

Figure 9:
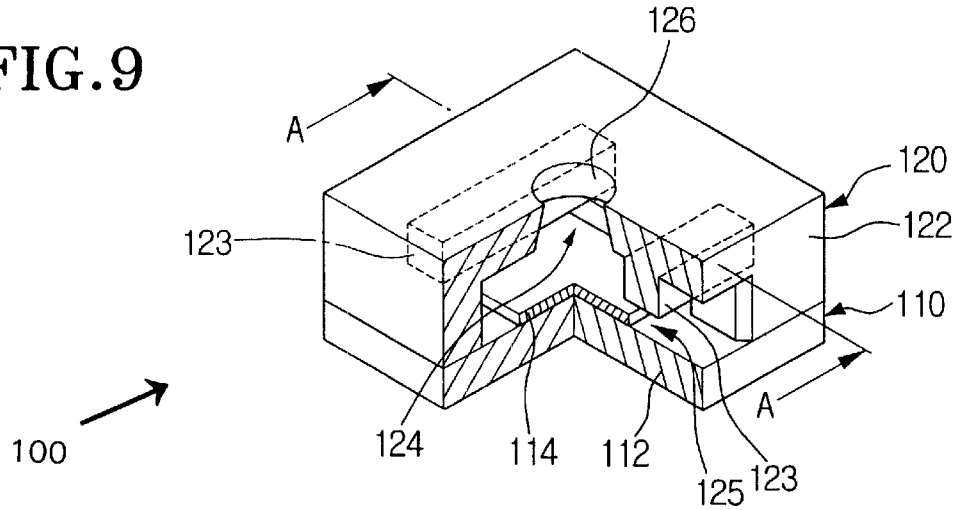
FIG. 9 is a perspective view schematically showing an ink jet printer head according to a second embodiment of the present invention.
Figure 10:
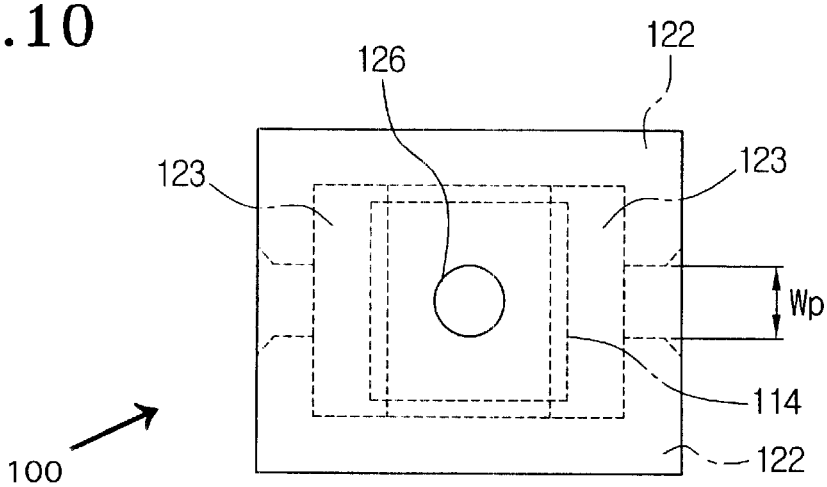
FIG. 10 is a top view schematically showing the ink jet printer head of FIG. 9.
Figure 11:
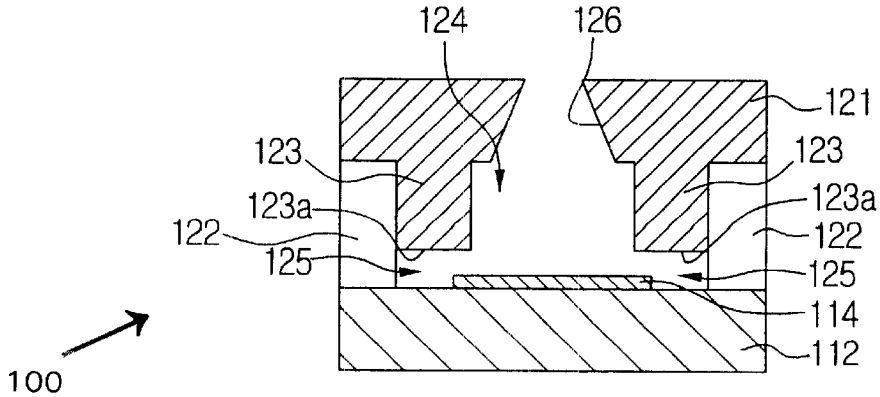
FIG. 11 is a cross-sectional view schematically showing the ink jet printer head of FIGS. 9 and 10.
Figure 12:
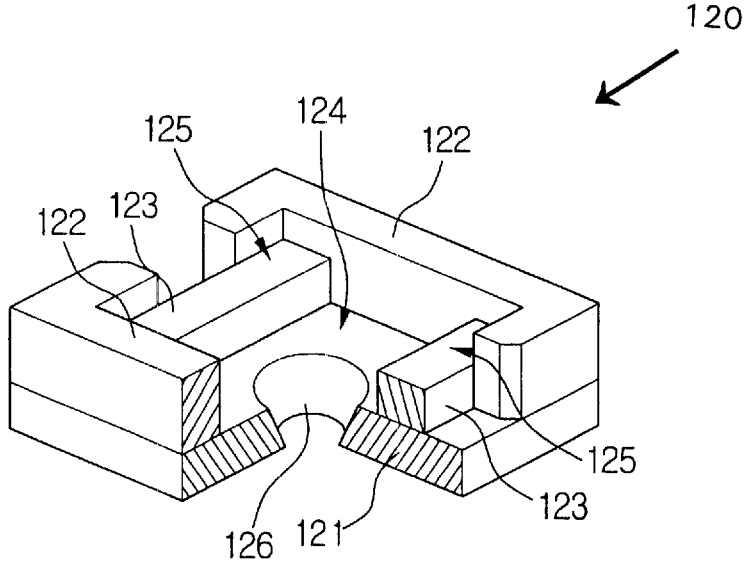
FIG. 12 is a perspective view of the nozzle section of FIG. 9.

FIGS. 9 to 11 are views of an ink jet printer head 100 according to a second embodiment of the present invention, showing an ink separating wall 123 being installed in an ink channel 125 having a reduced width ($w_p$) to increase the flow resistance in the reverse direction. By regulating the width ($w_p$) of the ink channel 125, i.e., by installing the ink separating wall 123 and extending both ends of the ink chamber barrier 122 towards the ink channel 125, the flow resistance in the reverse direction can be regulated. FIG. 12 illustrates the nozzle section 120 of FIG. 9.

Figure 13:
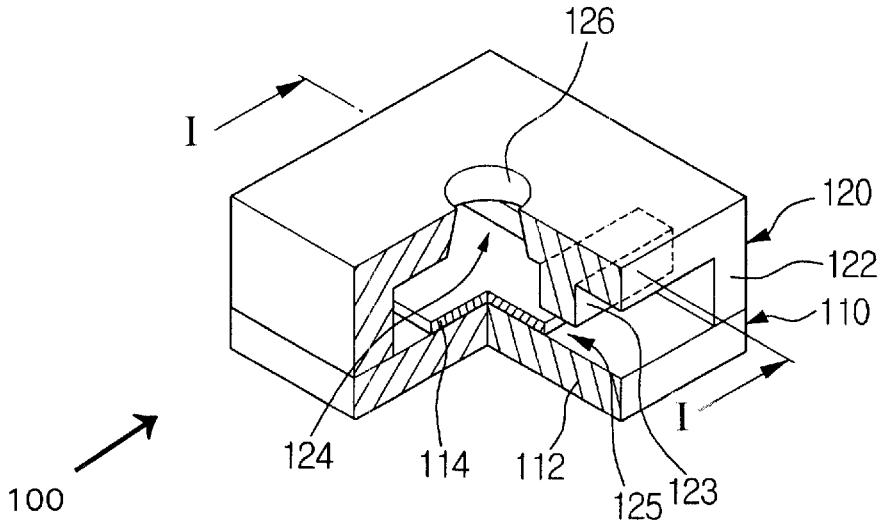
FIG. 13 is a perspective view schematically showing an ink jet printer head according to a third embodiment of the present invention.
Figure 14:
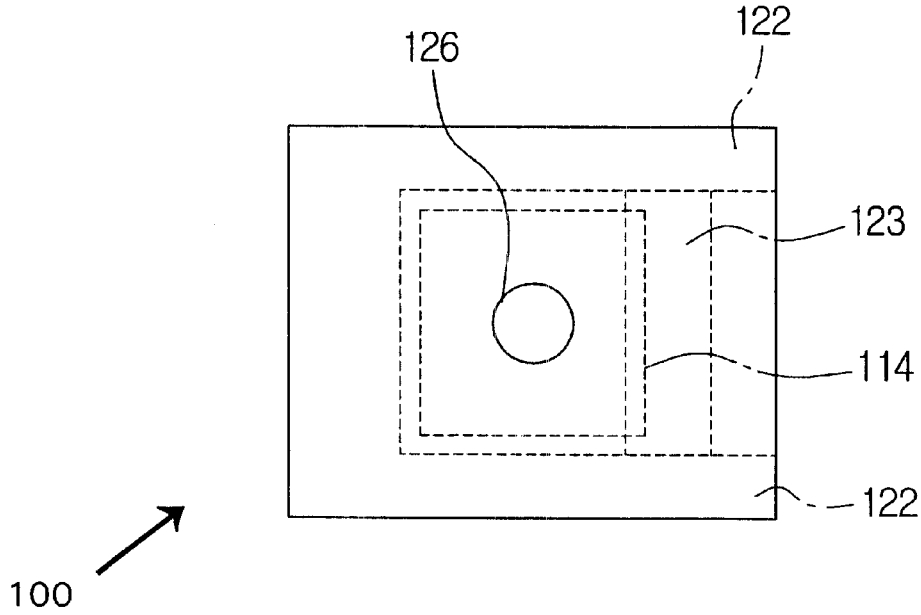
FIG. 14 is a top view schematically showing the ink jet printer head of FIG. 13.
Figure 15:
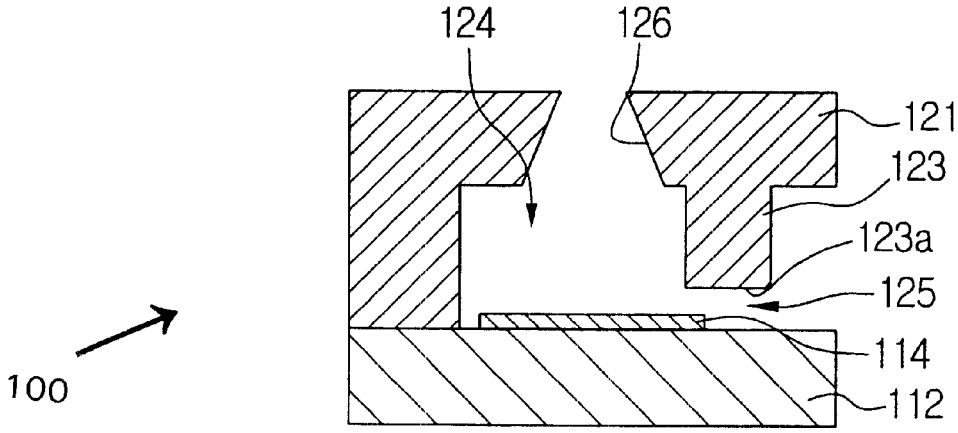
FIG. 15 is a cross-sectional view schematically showing the ink jet printer head of FIGS. 13 and 14.
Figure 16:
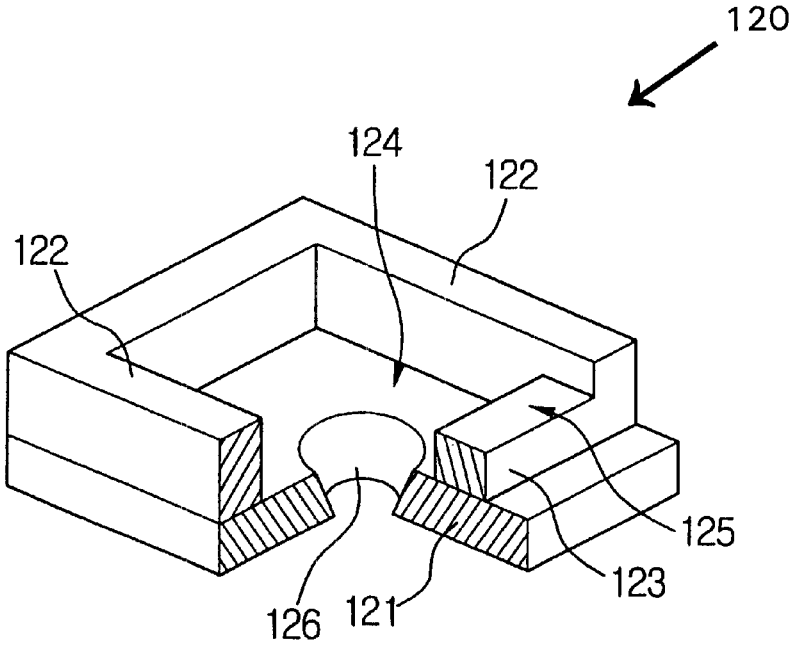
FIG. 16 is a perspective view of the nozzle section of FIG. 13.
Figure 17:
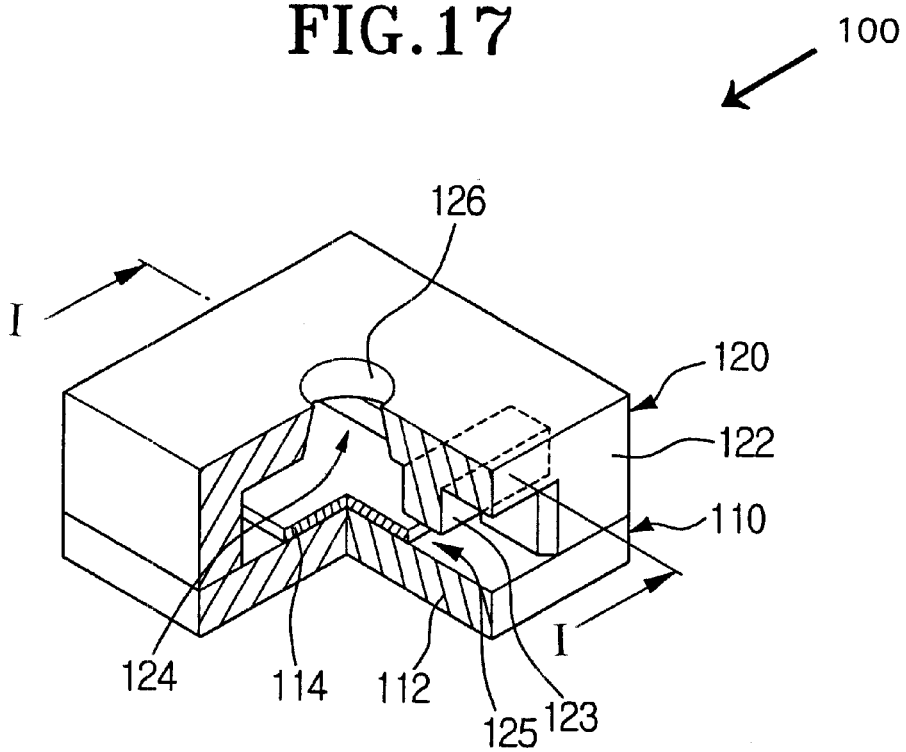
FIGS. 17 is a perspective view schematically showing an ink jet printer head according to the fourth embodiment of the present invention.
Figure 18:
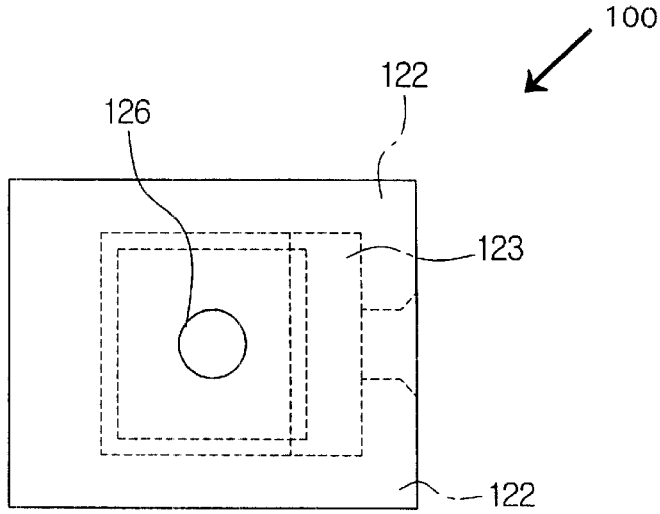
FIG. 18 is a top view schematically showing the ink jet printer head of FIG. 17.
Figure 19:
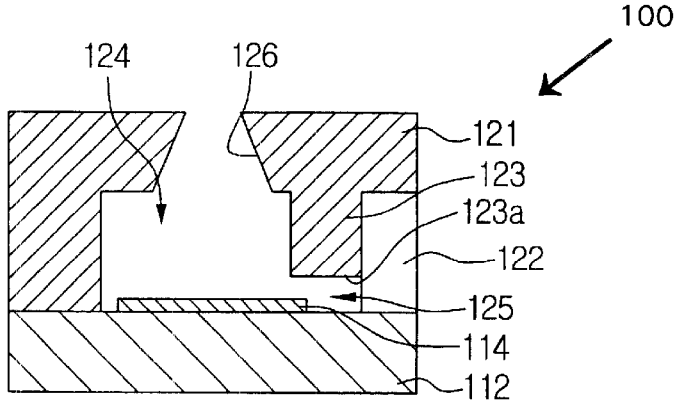
FIG. 19 is a cross-sectional view schematically showing the ink jet printer head of FIGS. 17 and 18.
Figure 20:
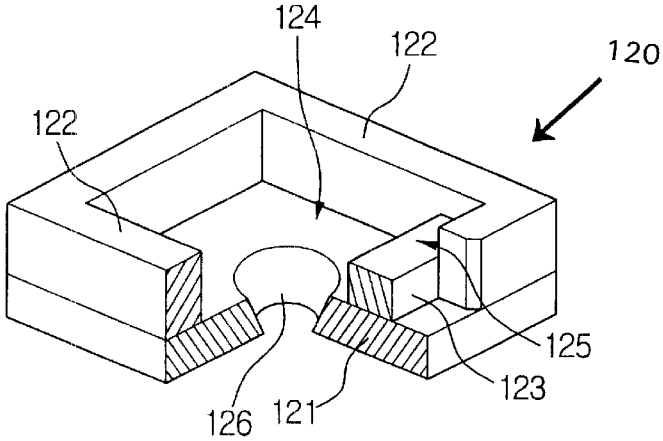
FIG. 20 is a perspective view of the nozzle section of FIG. 17.

FIGS. 13 to 15 show an ink jet printer head 100 according to the third embodiment of the present invention and FIG. 16 shows the nozzle section 120 of the ink jet printer head 100 of FIGS. 13 to 15. FIGS. 17 to 20 show an ink jet printer head 100 according to the fourth embodiment of the present invention.

Except for the fact that the third and fourth embodiments have only one ink channel 125, the first and second embodiments are identical to the third and fourth embodiments. Accordingly, an explanation of the third and fourth embodiments will be omitted.

According to the ink jet printer head 100 of the present invention, by installing the ink separating wall 123, the ink flow between the ink chamber 124 and the ink channel 125 is blocked by the bubble 2 which is generated to discharge the ink 1. Thus, the backflow of the ink 1 and the ink tail generated in the nozzle and the satellite droplet are reduced, and the printing efficiency and quality of the printing operation are improved. Furthermore, energy consumption is [not needed] reduced, and still further, because the process of installing the ink separating wall 123 is combined with the conventional chamber forming process without requiring separate devices or complex processes, the operational cost and the process cost are decreased. Also, since the ink channel 125 can be varied in the height direction to regulate the ink flow resistance, the length of the unit discharging structure can be reduced and the integration of the unit discharging structures in the inkjet printer head is improved.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An ink jet printer head comprising:

a substrate having a heat resisting body;

an ink chamber barrier formed on the substrate so as to form a side wall of an ink chamber to be filled with ink introduced through an ink channel; and a nozzle plate having a nozzle hole formed in the nozzle plate communicating with the ink chamber, the nozzle plate being formed on the ink chamber barrier, and the nozzle plate further having an ink separating wall protruding from a periphery of the nozzle hole towards the substrate located on the ink channel to interrupt a flow of the ink.

2. The ink jet printer head of claim 1, wherein an upper surface of the substrate is spaced from a tip end portion of the ink separating wall by a predetermined distance.

3. The ink jet printer head of claim 1, wherein a tip end portion of the ink separating wall is disposed on an upper side of a peripheral border line of the heat resisting body.

4. The ink jet printer head of claim 1, wherein a thickness of the ink separating wall is smaller than a distance between an upper surface of the heat resisting body and a lower surface of the nozzle plate.

5. The ink jet printer head of claim 1, wherein a length of the ink separating wall is smaller than a length of the ink channel.

6. The ink jet printer head of claim 1, wherein a width of the ink separating wall is smaller than a width of the ink chamber and larger than a width of the heat resisting body.

7. A printer head comprising:

an ink chamber barrier to form a side of an ink chamber;

an ink channel in communication with said ink chamber;

an ink separating wall protruding downward into said ink channel;

ink disposed in said ink chamber and said ink channel; and a nozzle plate forming a nozzle hole, said ink separating wall protruding from said nozzle plate, wherein said ink is heated to form a bubble, said bubble blocking a flow in a reverse direction of said ink from said ink chamber into said ink channel.

8. The printer head of claim 7, wherein a flow resistance in the reverse direction is greater than a flow resistance of said ink in a discharge direction from said ink chamber through said nozzle hole.

9. The printer head of claim 8, wherein the flow resistance of said ink in the reverse direction corresponds to a width of said ink channel.

10. The printer head of claim 9, further comprising a substrate spaced from said ink separating wall below said ink channel.

11. The printer head of claim 10, further comprising a heat resisting body disposed on said substrate, wherein a height of the ink separating wall is smaller than a distance between an upper surface of the heat resisting body and a lower surface of the nozzle plate.

12. The printer head of claim 11, wherein a width of the ink separating wall is smaller than a width of the ink chamber and larger than a width of the heat resisting body.

13. The printer head of claim 10, wherein a length of the ink separating wall is smaller than a length of the ink channel.

14. A printer head comprising:

an ink chamber barrier to form a side of an ink chamber;

an ink channel in communication with said ink chamber; and a nozzle hole through which said ink is ejected from said ink chamber in a first direction, wherein ink disposed in said ink chamber is heated to form a bubble, said bubble blocking a flow of said ink from said ink chamber into said ink channel in a second direction perpendicular to the first direction.

15. The printer head of claim 14, wherein only ink isolated in said ink chamber by said bubble is ejected through the nozzle hole.

* * * * *